US007257933B2

(12) United States Patent
Walters

(10) Patent No.: US 7,257,933 B2
(45) Date of Patent: Aug. 21, 2007

(54) DIVERSION SYSTEM AND METHOD

(75) Inventor: Arnold Bruce Walters, Austin, TX (US)

(73) Assignee: Senox Corporation, Austin, TX (US)

( * ) Notice: Subject to any disclaimer, the term of this patent is extended or adjusted under 35 U.S.C. 154(b) by 238 days.

(21) Appl. No.: 10/464,114

(22) Filed: Jun. 18, 2003

(65) Prior Publication Data

US 2004/0025445 A1 Feb. 12, 2004

Related U.S. Application Data

(60) Continuation of application No. 10/105,099, filed on Mar. 22, 2002, which is a continuation of application No. 10/001,005, filed on Nov. 15, 2001, now Pat. No. 6,568,132, which is a division of application No. 09/962,996, filed on Sep. 25, 2001, now Pat. No. 6,470,628, which is a continuation of application No. 09/880,412, filed on Jun. 12, 2001, now Pat. No. 6,453,622.

(51) Int. Cl.
*E04G 21/00* (2006.01)

(52) U.S. Cl. ..... 52/745.06; 52/11; 29/564.1; 29/787; 29/795; 29/430

(58) Field of Classification Search ..... 52/12, 52/11; 248/48.1, 48.2
See application file for complete search history.

(56) References Cited

U.S. PATENT DOCUMENTS

| | | | |
|---|---|---|---|
| 603,611 | A | 5/1898 | Nye |
| 836,012 | A | 11/1906 | Cassen |
| 891,405 | A | 6/1908 | Cassens |
| 891,406 | A | 6/1908 | Cassens |
| 2,536,704 | A | 1/1951 | Shea et al. |
| 2,636,458 | A | 4/1953 | Harris |
| 2,669,950 | A | 2/1954 | Bartholomew |
| 2,672,832 | A | 5/1954 | Goetz |
| 2,873,700 | A | 2/1959 | Heier |
| 3,080,682 | A | 3/1963 | Teutsch |
| 3,189,304 | A | 6/1965 | Vranyosovics |
| 3,752,428 | A | 8/1973 | Trostle et al. |

(Continued)

*Primary Examiner*—Carl D. Friedman
*Assistant Examiner*—Yvonne M. Horton
(74) *Attorney, Agent, or Firm*—Fish & Richardson P.C.

(57) ABSTRACT

In a water diversion system, in a preferred embodiment, a first fold of a deflector is disposed into a first hanger cavity and a second deflector fold is disposed into a second hanger cavity. The first fold of the deflector cooperates with the first cavity of the hanger to allow a resistance hinge-like action of the deflector. The deflector may be lifted open by compression of a curve of the deflector to remove the second fold of the deflector from the second hanger cavity. Methods are provided in which, in a preferred embodiment, a deflector-forming machine is disposed above a trough-forming machine and the deflector-forming machine is moveable forward and backward relative to the trough-forming machine. In another preferred method, material cradles for the respective machines are loaded with coil and disposed relative to each other above the deflector-forming machine that is placed above the trough-forming machine as material for the trough-forming machine passes over at least a portion of the material cradle for the deflector-forming machine. Two-armed run-out stands having upper and lower arms provide work placement for lengths of deflector and trough. Preferably, end caps are two-piece, with one piece fitted to a trough length and a second piece fitted to a deflector length.

13 Claims, 15 Drawing Sheets

U.S. PATENT DOCUMENTS 4,000,587 A 1/1977 Weber
4,195,452 A 4/1980 Smith et al.
4,199,121 A 4/1980 Le Febvre
4,241,548 A 12/1980 Rowe
4,294,422 A 10/1981 Odekirk
4,333,208 A 6/1982 Fuller
4,404,775 A 9/1983 Demartini
4,411,110 A 10/1983 Carey
4,433,512 A 2/1984 Schoener
4,435,925 A 3/1984 Jefferys
4,493,588 A 1/1985 Duffy
4,592,174 A 6/1986 Hileman
4,757,649 A 7/1988 Vahldieck
4,776,544 A 10/1988 Williams
4,876,827 A 10/1989 Williams
4,941,299 A 7/1990 Sweers
4,951,430 A 8/1990 Gottlieb
5,007,224 A 4/1991 Segneri
5,040,750 A 8/1991 Brant
5,072,551 A 12/1991 Manoogian, Jr.
5,098,045 A 3/1992 Pepper
5,245,800 A 9/1993 Davenport
5,253,456 A 10/1993 Todd
5,271,192 A 12/1993 Nothum, Sr. et al.
5,356,164 A 10/1994 Miller
5,388,377 A 2/1995 Faulkner
5,394,722 A 3/1995 Meyer
5,457,916 A 10/1995 Tenute
5,459,965 A 10/1995 Meckstroth
5,537,785 A 7/1996 Zaccagni
5,551,272 A 9/1996 Knudson
5,555,680 A 9/1996 Sweers
5,570,860 A 11/1996 Schoenherr
5,575,118 A 11/1996 Vahldieck
5,617,678 A 4/1997 Morandin et al.
5,619,825 A 4/1997 Leroney et al.
5,638,643 A 6/1997 Demartini et al.
5,640,809 A 6/1997 Iannelli
5,687,936 A 11/1997 Wilson
5,737,879 A 4/1998 Sweet
5,740,687 A 4/1998 Meyer et al.
5,845,435 A 12/1998 Knudson
5,875,590 A 3/1999 Udelle
5,893,240 A 4/1999 Ealer, Sr.
6,073,398 A 6/2000 Williams
6,151,836 A 11/2000 McGlothlin et al.
6,161,338 A 12/2000 Kuhns
6,209,826 B1 4/2001 Pratt, Jr.
6,254,039 B1 7/2001 Zimmerman

DIVERSION SYSTEM AND METHOD

CROSS-REFERENCE TO RELATED APPLICATIONS

This application is a continuation of U.S. patent application Ser. No. 10/105,099, filed Mar. 22, 2002, pending, which is a continuation of U.S. patent application Ser. No. 10/001,005, filed Nov. 15, 2001, now U.S. Pat. No. 6,568,132, issued May 27, 2003, which is a divisional of U.S. patent application Ser. No. 09/962,996, filed Sep. 25, 2001, now U.S. Pat. No. 6,470,628, issued Oct. 29, 2002, which is a continuation of U.S. patent application Ser. No. 09/880,412, filed Jun. 12, 2001, now U.S. Pat. No. 6,453,622, issued Sep. 24, 2002 all four of which recited applications are incorporated herein by reference for all purposes.

TECHNICAL FIELD

The present invention relates to rain and run-off collection and diversion systems and, in particular, to systems and methods for such systems that exhibit reduced debris accumulation.

BACKGROUND OF THE INVENTION

Diversion of rain from buildings is a well-known and beneficial practice. For centuries, architects and builders have understood the benefits of diverting rain to forestall erosion, maintain structural stability, and preserve vegetation. In recent decades, a multitude of systems have been developed to divert rain from structures and homes. Typically, such systems have been placed beneath or adjacent to the roofline to allow collection and diversion of rain accumulated from across the surface area of the structure roof. Such systems are sometimes called "gutter" systems.

Frequently, rain diversion systems employ gutters that are open channels to collect run-off from the roof. Diversion or gutter systems devised with open-channeled rain gutters tend to accumulate debris including sticks, leaves and other matter that is swept toward the gutter by the gravity-induced flow of water down the pitch of the roof. Such debris can cause malfunction of the system as well as significant problems with leakage and corrosion. Roof and structural rotting as well as erosion can be precipitated by the consequent accumulation of water without appropriate attendant diversion.

Consequently, a variety of gutter systems of varying complexity have been developed to inhibit debris accumulation in gutter systems. Simple systems have merely placed screens across open-faced gutter channels. These techniques commonly have their own debris accumulation problems. Other systems employ a deflector described by various terms such as "hood" or "shield" that deflect debris while the gutter accumulates water for diversion to determined locations. For example, in U.S. Pat. No. 4,757,649 to Vahldieck, a system is described that purportedly preferentially collects water and deflects debris over a continuous double-curved shield through which a spike passes to affix the shield to a back support wall of the gutter. The use of shields and other deflectors is well known, and a variety of prior systems modify the shape of the deflector to purportedly take better advantage of the surface tension qualities of diverted run off. For example, in U.S. Pat. No. 4,404,775 to Demartini, a system of longitudinal ridges is imposed on a deflector and is said to improve adhesion of the water to the deflector to improve transference to the gutter.

Others have developed systems to support debris deflectors or affix the deflector to the gutter. For example, in U.S. Pat. No. 4,497,146 to Demartini, a rain deflector support is described that purports to support the underside of a rain gutter deflector while positioning the deflector in relation to the gutter.

As diversions systems have become more complicated, so have the associated issues of cost, specialized material stock, and installation efficiency become more unwieldy. For example, most systems that employ a deflector affix the deflector with screws or clips that reduce flexibility of the system or add an extra part (in addition to the hanger) to the assembly. If the deflector cannot be easily unfastened from the gutter, repair and maintenance are complicated.

For a variety of reasons, diversion systems that deflect debris have not been adopted as widely as demand would suggest. There are a variety of reasons for this result. One reason for the minimal market penetration is the use of non-standard widths of metal stock or "coil" for the gutter trough above which the deflector is positioned. Non-standard coil sizes add significantly to the cost and availability of such systems.

There are two principal sizes of coil used to form the gutter channels known in the art as "troughs." For the widely found five inch-wide (5") gutter troughs, standard coil material of 11 and ⅞ inches (11⅞") is employed (except in the Northeastern U.S. where 5" gutter troughs are formed from 11 and ¾ inch (11¾") stock). For the less widely found, but still common, six inch (6") trough, fifteen inch (15") coil is used.

In almost all deflection systems, when installed, a deflector must be inclined by a degree sufficient to impart velocity to the run-off great enough to impel debris from the deflector. This requires that the back of the trough, proximal to which the deflector is attached, be high enough to provide sufficient incline for the deflector. Debris deflection systems for 5" trough gutters employ non-standard coil for the gutter as a result of taking material from the front of the trough to raise the back wall of the gutter. With known designs, if standard width coil of 11⅞ inches were used to form the trough, the shift of material around the standard trough form factor (as employed in the art to create the "OG" 5 inch gutter) from the front trough channel containment wall to the back wall of the trough to provide sufficient deflector inclination leaves insufficient material for the front This process takes, however, material from the front border area of the trough to create the stiffening front channel edge that provides installation stability and standard hanger affixation capability.

The shape of the front of the gutter trough contributes to structural stability and, in some systems, provides an interface for hanger or deflector attachment. In particular, the shape of the border area of the gutter trough can significantly affect gutter stability during installation, an important consideration in any gutter system. Typically, lengths of gutter trough are formed in runs approximately 40 feet long. Without sufficient resistance to deformation, the gutter trough may fold or crease, particularly when being moved during installation, thus limiting run lengths and increasing installation difficulty. Consequently, 5" gutter troughs with debris deflectors have typically used coil wider than 11⅞" or 11¾" for gutter formation to provide material sufficient to provide a stabilizing front gutter channel configuration with a raised back gutter trough wall to accommodate appropriate inclination of the deflector. Consequently, because of the higher cost of non-standard material, in particular, deflector-fitted 5" trough gutter systems have cost significantly more than open-faced 5" trough gutter systems crafted from standard sized coil material.

Previous system design, whether with 5" or 6" gutter troughs, has also contributed to unwieldy installation techniques, further increasing the expense of diversion systems that employ deflection hoods or shields. Some deflection systems form the trough and deflector from one piece of material. More commonly, the trough and deflector are separately formed and joined in place at the structure roof edge. Typically, two forming machines are employed during installation of a two-piece deflection system. One machine is dedicated to gutter trough formation, while the other is configured to form the deflector. The machines are typically placed side-by-side. The installation team typically first forms trough lengths sufficient to gutter the structure. The troughs are then affixed in place on the structure. After the troughs are fastened to the building, corresponding deflectors are formed and affixed to the in-place troughs. This process requires multiple trips to and from the forming machines as well as at least two trips up a ladder to install separately, the two large pieces of the system. The described process requires dexterity which, even if applied, cannot ameliorate the difficulty of moving long lengths of deflector that lack structural rigidity unless affixed to, and combined with, the gutter trough.

The inflexible nature of the affixation between hood and trough in prior systems results in several shortcomings. Replacement of deflector sections is made difficult by the inflexible nature of the affixation between deflector and trough. Nail or screw attachment of the deflector is at least semi-permanent, and when the deflector is attached by such means, the system is less easily repaired, serviced, or replaced. Other systems have more sophisticated deflector-attachment techniques, but those systems lack installation flexibility. For example, in U.S. Pat. No. 5,845,435 to Knudson, there is there purportedly described a system having a hood which snaps into particularly configured hangers affixed along the length of the gutter trough. In this system however, the deflector is opened wider to embrace coupling portions of a fastening support device. This is difficult to do with one hand. Installation flexibility is also minimal because, as described in Knudson, the hanger and trough are affixed to the structure before the deflector is attached to the gutter trough. As in other prior systems, this prevents creation of a structurally sound member before the deflector and gutter trough assembly is moved from the machine site to the eventual installation location, an advantage for installation having considerable value in reducing labor cost and inconvenience.

Consequently, what is needed therefore, is a rain collection and diversion system that employs standard-sized coil, has structural soundness and strength, and can be partially assembled close to the machine-site while being easily installed.

SUMMARY OF THE INVENTION

In a water diversion system, in a preferred embodiment, a deflector is selectably attached to a hanger by insertion of a first fold into a first hanger cavity and insertion of a second fold into a second hanger cavity. In the preferred embodiment, the first fold of the deflector cooperates with the first cavity of the hanger to allow a resistance hinge-like action of the deflector. The deflector may be lifted open by compression of a curve of the deflector to remove the second fold of the deflector from the second hanger cavity. In another embodiment, a penetrative prong at the rear of a hanger cooperates with a dimple on the back wall of a trough to preliminarily position the hanger. Methods for formation of a rain diversion system are provided in which, in a preferred embodiment, a deflector-forming machine is disposed above a trough-forming machine and the deflector-forming machine is moveable forward and backward relative to the trough-forming machine. In another preferred method in accordance with the present invention, material cradles for the respective machines are loaded with coil and disposed above the deflector-forming machine that is placed above the trough-forming machine and the cradles are disposed relative to each other so that material for the trough-forming machine passes over the material cradle for the deflector-forming machine. In another preferred aspect, two-armed run-out stands having upper and lower arms provide work placement for lengths of deflector and trough. Preferably, end caps are two-piece, with one piece fitted to a trough length and a second piece fitted to a deflector length.

DETAILED DESCRIPTION OF PREFERRED EMBODIMENTS

Figure 1:
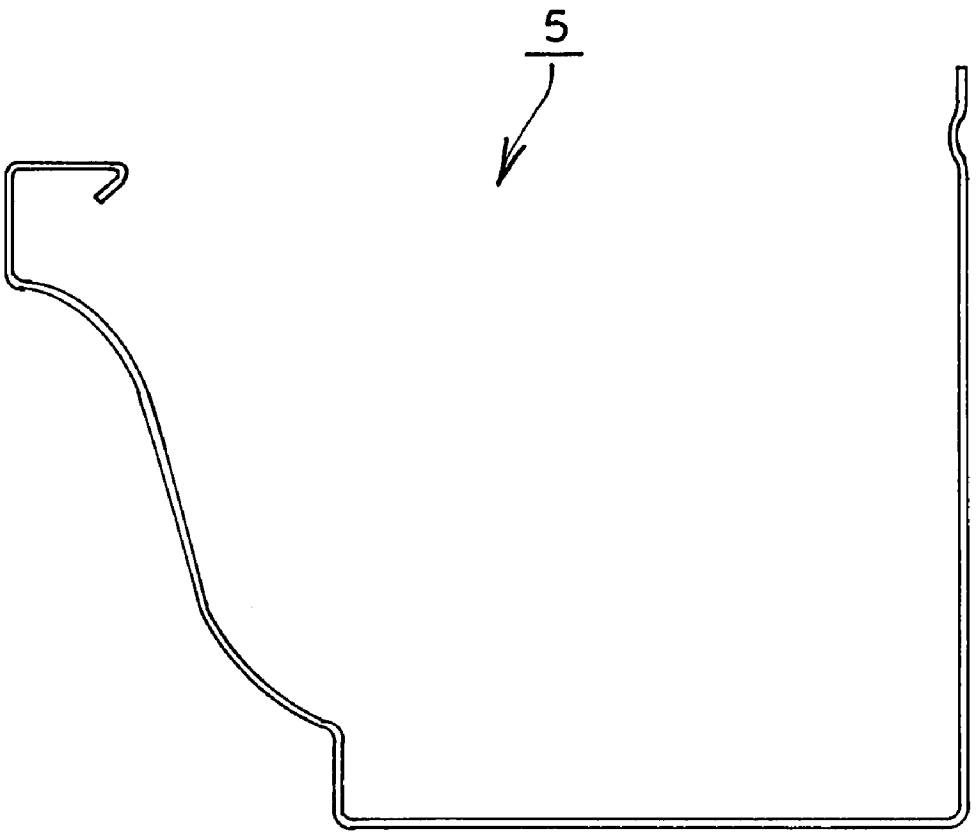
FIG. 1 (PRIOR ART)
FIG. 1 depicts a cross-sectional view of a prior art trough of a configuration that is common in the field.

FIG. 1 depicts a cross-sectional view of a prior art trough 5 of standard configuration that is common in the field. As shown in FIG. 1, the depicted trough 5 has a folded edge or shelf along its front containment wall.

Figure 2:
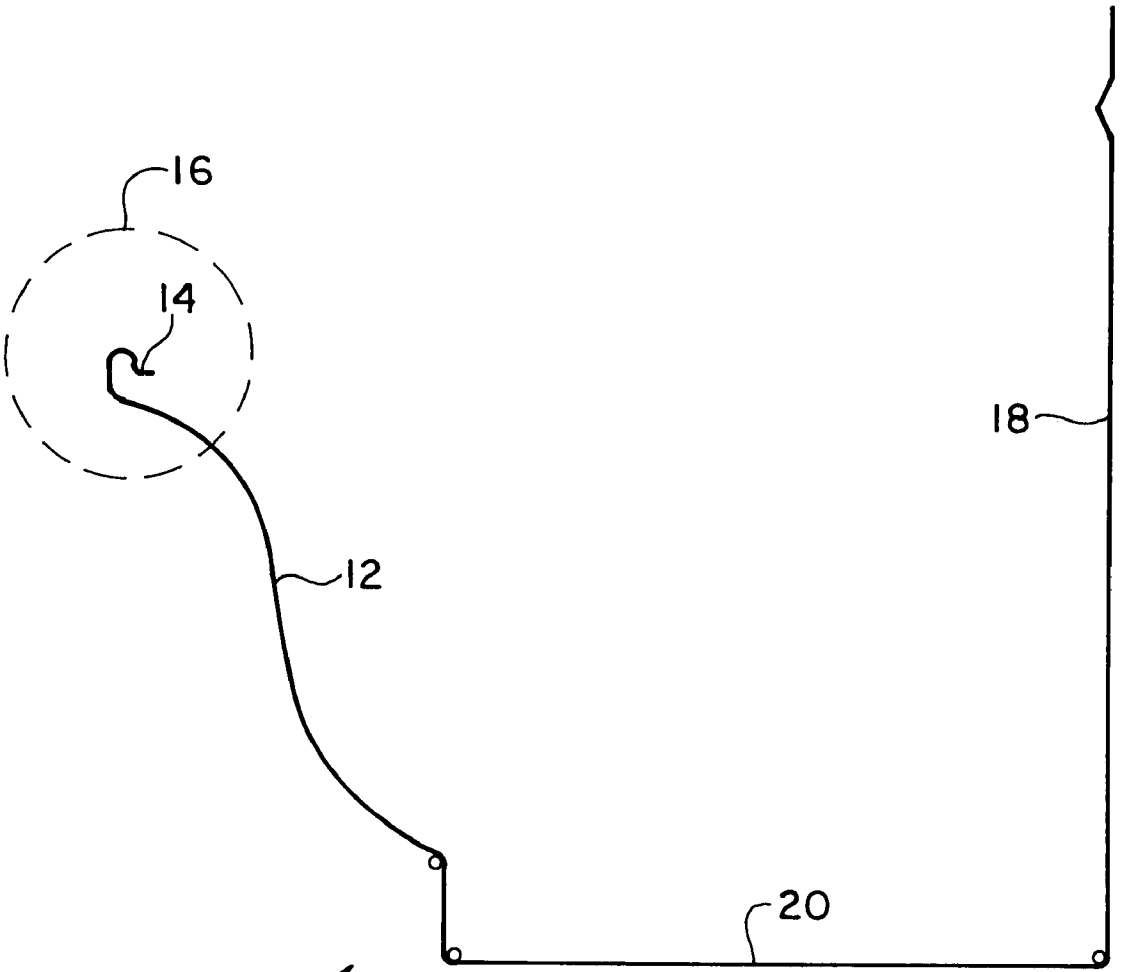
FIG. 2 depicts a cross-sectional view of a trough configured in accordance with a preferred embodiment of the present invention.

FIG. 2 depicts a cross-sectional view of a trough 10 configured in accordance with a preferred embodiment of the present invention. Trough 10 has a front containment wall 12 that has an inwardly projecting shelf 14 that is part of containment wall border area 16 of front containment wall 12. Trough 10 has a back wall 18. As shown, containment wall 12 need not be a planar wall but may take a variety of shapes and configurations to provide a containment function for collected liquid. Between front containment wall 12 and back wall 18, a channel is formed for water collection and diversion bottomed with floor 20. In an embodiment having a rounded or "half-round" trough, it will be recognized that there is no distinct floor 20 and front containment wall 12 and back wall 18 will not have traditional "wall" planar areas but blend into an arcuate floor area.

In a 5-inch embodiment of trough 10 in which there is approximately 5 inches between back wall 18 and the farthest reach of containment wall border area 16, standard material coil of 11⅞ inches may be employed. As those of skill in the art will recognize standard material coil may exhibit some variation in width depending upon manufacturer or local custom. Consequently, in a preferred embodiment employing standard material, standard material between 11⅝ inches and 12 inches in width may be employed to create trough 10 with a 5 inch opening. Certainly other sizes of troughs can be created to advantage by employment of the present invention. For example, the well-known 6-inch trough can be created in conformity with an alternative embodiment of the present invention by use of 15 inch material coil. Containment wall border area 16 may be formed by bending, folding, forming or other of the well-known means for configuring trough 10. A preferred method for creating containment wall border area 16 is with a roller-based machine at the same time that the configuration of trough 10 is created from coil stock. When a 5 inch trough in accordance with a preferred embodiment of the present invention is created with a roller-based machine, the standard material coil stock is positioned so as to move the furthest reach of the formed back wall between ¾ and 1 inch from the place the furthest reach of the back wall would occupy in formation of a standard OG gutter trough so as to bring greater height to the back wall for deflector inclination during trough formation. As well as using forms in accordance with the present invention, the material is shifted around the form relative to the material placement employed in forming the OG gutter.

Figure 3:
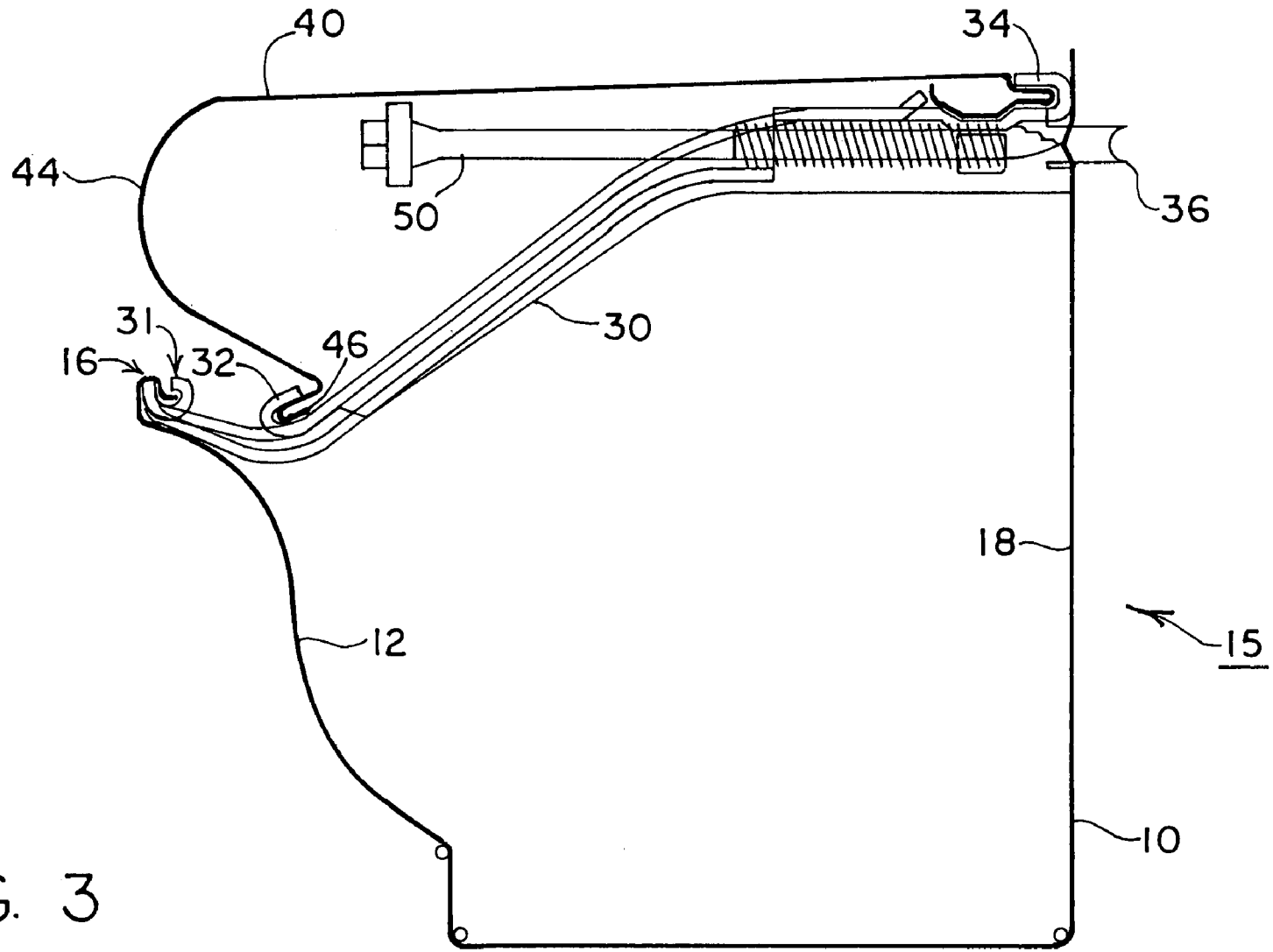
FIG. 3 depicts a cross-sectional view of a trough, hanger and deflector assembly in accordance with a preferred embodiment of the present invention.

FIG. 3 depicts as assembly 15, a cross-sectional view of trough 10 in use with hanger 30 and deflector 40 in accordance with a preferred embodiment of the present invention. The system described can be used either with or without deflector 40.

Figure 4:
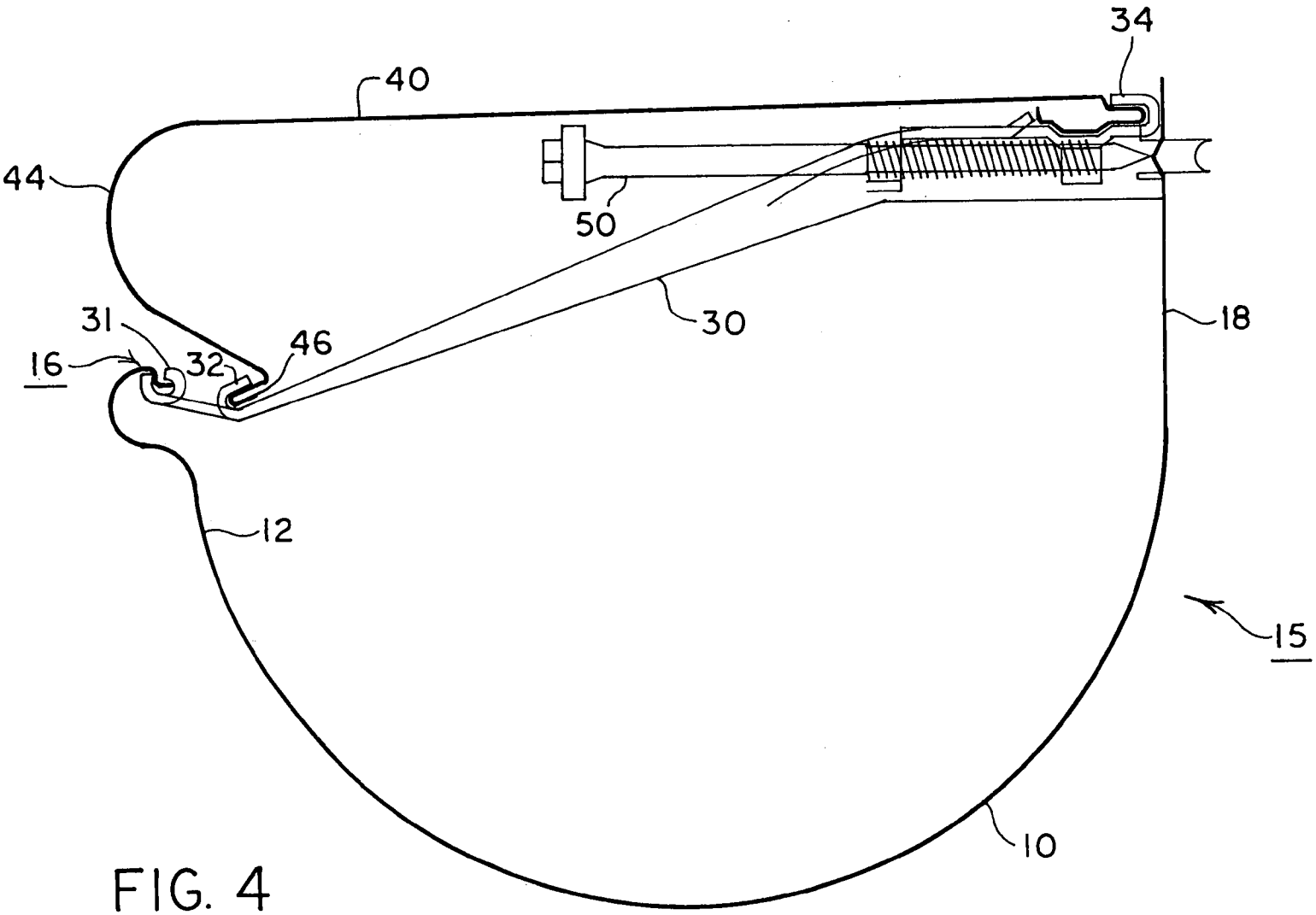
FIG. 4 depicts a cross-sectional view of a half-round trough, hanger and deflector assembly in accordance with a preferred embodiment of the present invention.

As shown in FIG. 3, hanger 30 includes optional deflector attachment cavities 32 and 34. In the depicted embodiment, hanger 30 is stamped from metal, but any number of materials and formation techniques may be used to create a hanger 30 having the features described here. For example, hanger 30 may be made of metal or plastic such as Teflon, or higher strength polys. If made of metal, hanger 30 can be forged, stamped, extruded, die cut or cast or other technique familiar to the trade. Hanger 30 includes receptive cavity structure 31 that will be later described in more detail while front containment wall 12 exhibits containment wall border area 16 that will be described in more detail. FIG. 4 depicts a cross-sectional view of a half-round trough assembled with a hanger and deflector in accordance with a preferred embodiment of the present invention.

Figure 5:
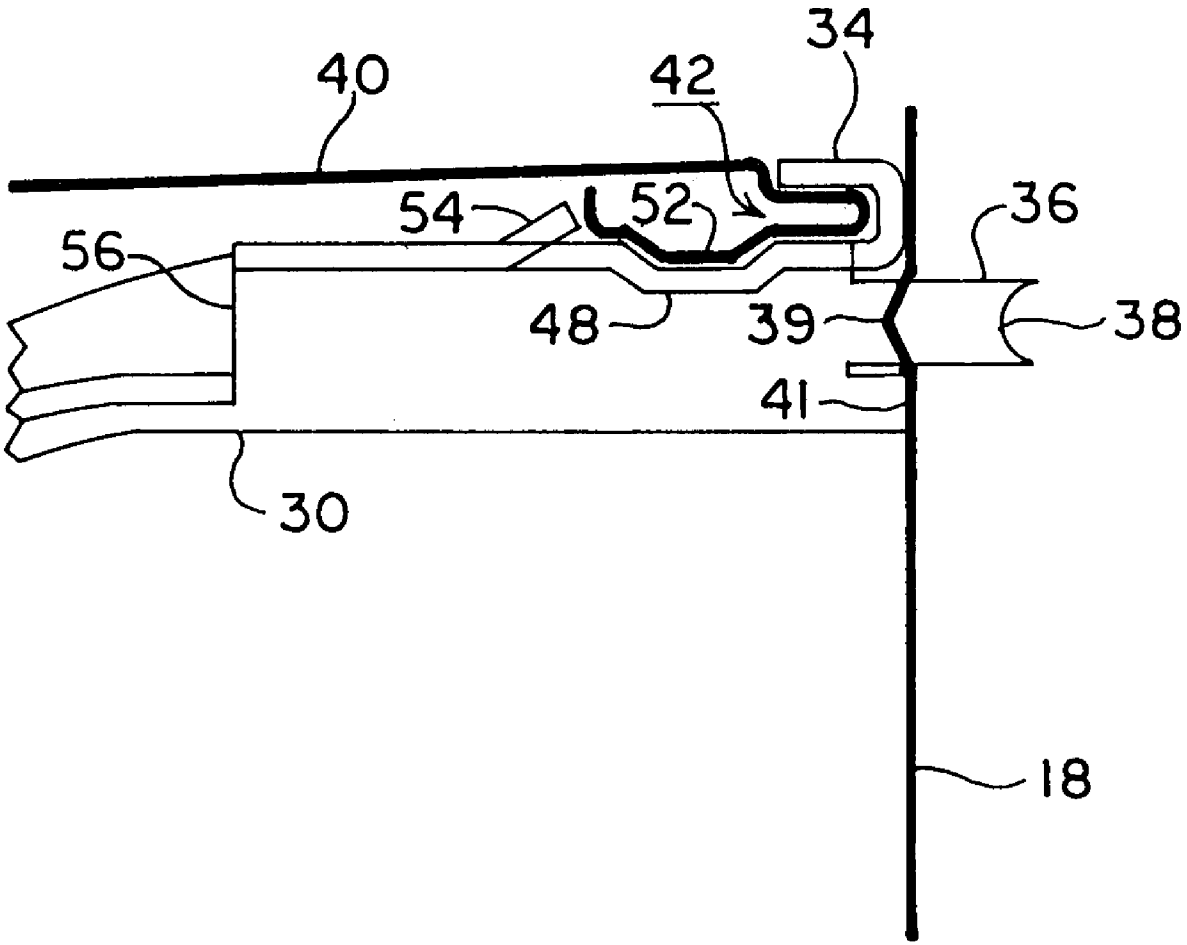
FIG. 5 depicts a cross-section of an enlarged area of the trough, hanger, and deflector depicted in FIG. 3.

With reference to FIGS. 3 and 5 (which figure illustrates an enlarged portion of FIG. 3 about the area of flex fold 42), deflector 40 is selectably attached to hanger 30 by insertion of flex fold 42 into cavity 34 and insertion of attachment fold 46 into cavity 32. In a preferred compression embodiment, curve 44 provides a ready method to accomplish this selective attachment. Those of skill in the art will recognize that flex fold 42 and attachment fold 46 are first and second long axis perimeters of deflector 40 and need not be "folds" but may be any edge or fold or border of the deflector which may be inserted into the appropriate cavity of the hanger. This selectable attachment feature of deflector 40 as shown in this depiction of a preferred embodiment of the present invention allows assemblage of deflector 40 to hanger 30 before the assembly 15 is installed on a structure.

As shown in conjunction with FIG. 3 and FIG. 5, hanger 30 has optional penetrative prongs 36 shown penetrating back wall 18 of trough 10. As shown more closely in FIG. 5, prongs 36 preferably have a concavity 38 that cooperates with dimple 39 on back wall 18 to preliminarily position hanger 30 for prong insertion through back wall 18 with an appropriate compression tool such as a specialized pliers or other readily available and adapted instrument. Back abutment 41 of hanger 30 is placed against back wall 18 with concavity 38 placed against dimple 39 and the compression tool pushes prongs through the back wall 18. There need not be a specially configured structure for an abutment for hanger 30, the back of the structure of hanger 30 disposed against back wall 18 being the abutment. The prongs are folded by the compression tool against the back of back wall 18 to affix hanger 30. This operation can be performed before attachment of the trough to the structure and may be performed at the machine site or elsewhere to affix back wall 18 in relation to front containment wall 12 while creating a mechanically sound structure ready for attachment of deflector 40. Hanger 30 need not have prongs 36 but their use is advantageous.

As described with continuing reference to FIGS. 3 and 5, flex fold 42 of deflector 40 cooperates with cavity 34 to allow a resistance hinge-like action of deflector 40. In particular, deflector 40 may be lifted from hanger 30 by compression of curve 44 of deflector 40 to remove attachment fold 46 of deflector 40 from cavity 32. The forward part of deflector 40 is then lifted from its position as flex fold 42 and cavity 32 allow a spring-like rotational opening of a gap between deflector 40 and hanger 30 through which fastener 50 may manipulated to install assembly 15 on the structure as fastener 50 is screwed or pounded or otherwise inserted into place. In embodiments with penetrative fasteners, fastener 50 may be a nail or screw or spike or other such projecting fastener, many of which are common in the field. Other techniques for hanging assembly 15 are known in the art. Hanger 30 includes, in a preferred embodiment, indent 48 to mate with ridge 52 of deflector 40 while stop 54 of hanger 30 inhibits deflector 30 from unpredicted separation from hanger 30, particularly during installation or servicing. In a preferred embodiment, fastener 50 slides into a guide slot 56 created in hanger 30 to avoid addition of height or special platforms to hanger 30. The compression fitting of deflector 40 into cavities 32 and 34 allows ready placement of deflector 40 on the trough 10 and hanger 30 combination at the machine-site to allow a single installation trip from machine site to installation site with the combined structure of deflector and trough.

Figure 6:
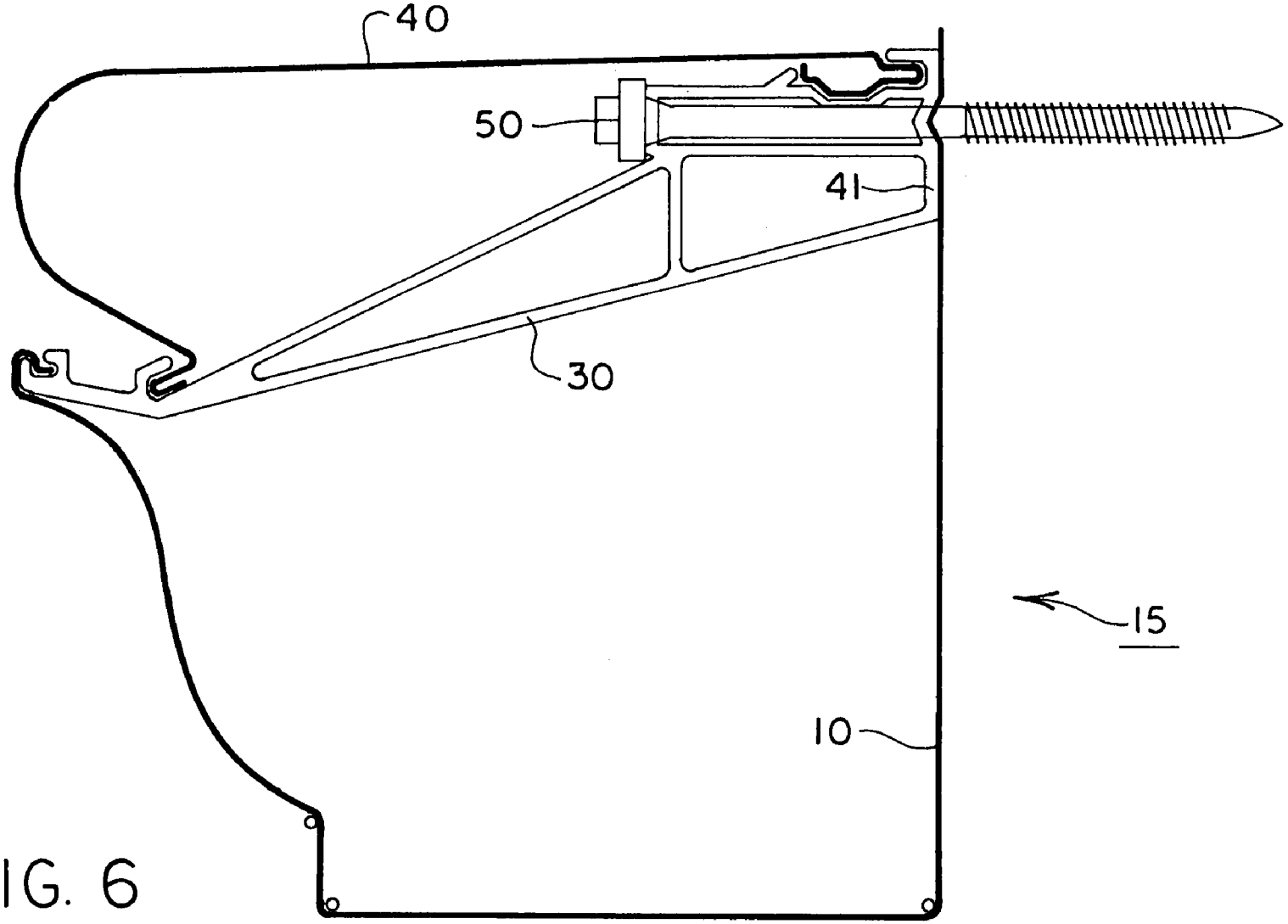
FIG. 6 depicts another embodiment of trough, hanger, and deflector devised in accordance with a preferred embodiment of the present invention.

FIG. 6 depicts another embodiment of assembly 15 devised in accordance with the present invention and which employs an extruded hanger 30. FIG. 6 depicts fastener 50 as it would be engaged into a structure. Those of skill in the art will recognize that the disclosed configuration allows the front of deflector 40 to be lifted from hanger 30 to insert fastener 50 into the structure.

Figure 7:
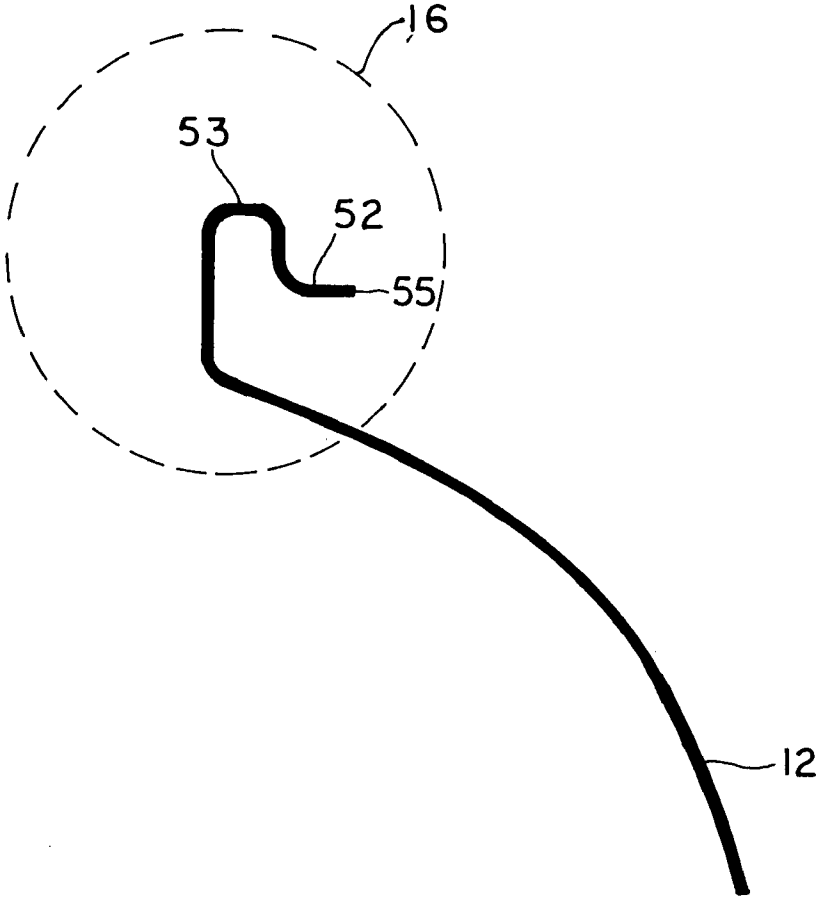
FIG. 7 is an enlarged depiction showing a containment wall border area of a trough configured in accordance with a preferred embodiment of the present invention.
Figure 10:
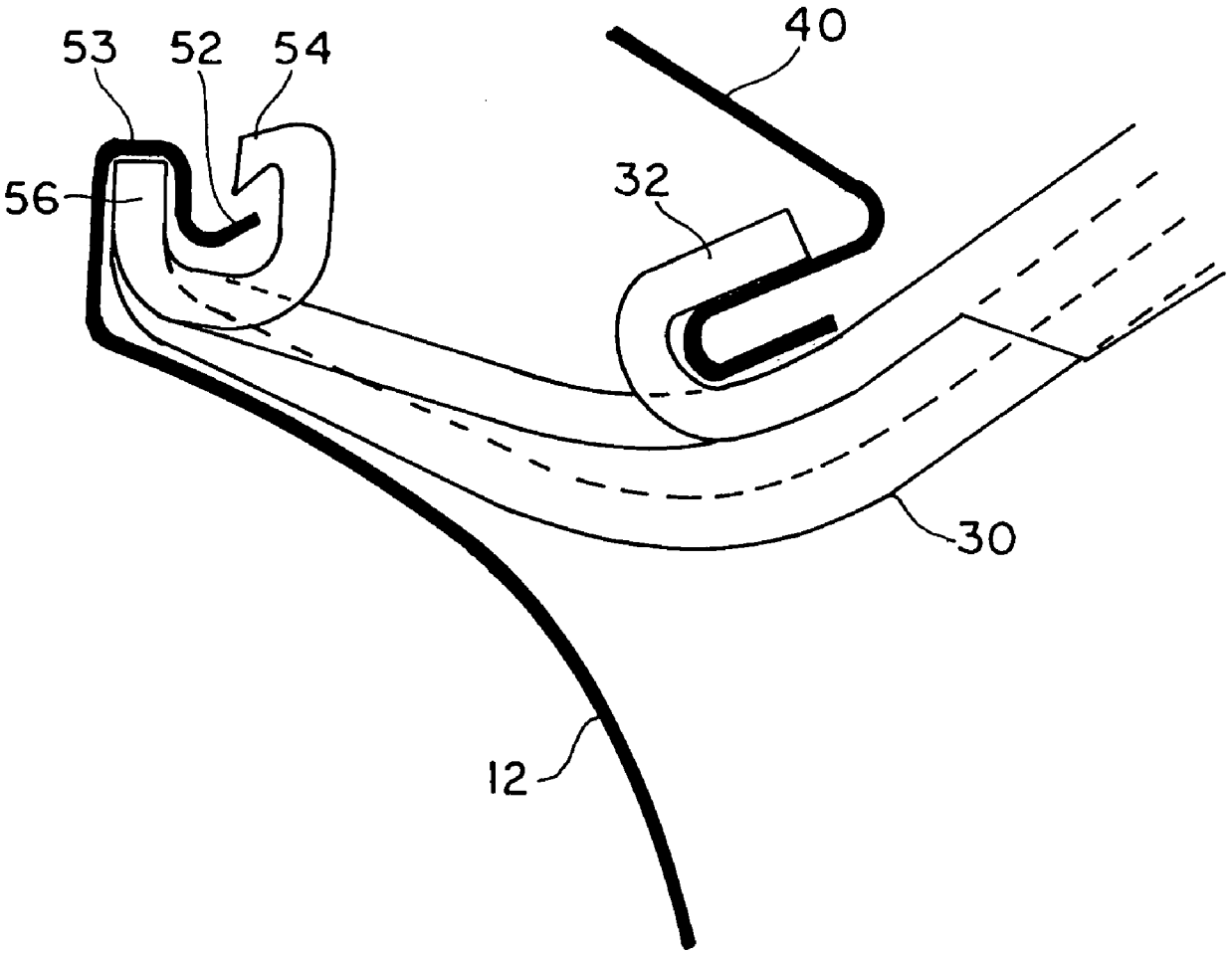
FIG. 10 depicts the border area of a trough and a receptive cavity structure of a hanger configured in accordance with an alternative embodiment of the present invention.

FIG. 7 is an enlarged depiction showing containment wall border area 16 of trough 10 of FIG. 3. As shown in FIG. 7, containment wall border area 16 includes containment edge or shelf 52 that extends inwardly to the trough. Either part or all of containment shelf 52 may extend inwardly to the trough and that inward extension may be at an angle or horizontal orientation. In a preferred embodiment, containment wall border area 16 includes rise 53. Containment shelf 52 may be folded, or a single material thickness and may extend horizontally (as shown in the preferred embodiment view of FIG. 7) or at an angle from the horizontal as shown in FIG. 10, or have a vertical extension as shown, for example, in FIG. 11. Part or all of shelf 52 can, but need not, be canted at an angle to match the configuration of containment lip 54 of receptive cavity structure 31 of hanger 30. Consequently, those of skill in the art will recognize that containment lip 54 may take a variety of configurations to cooperate with the variety of configurations of containment shelf 52 within the scope of the invention to extend a portion of containment lip 54 over a portion of containment shelf 52 and thereby, according to the vernacular of the present disclosure, "mate" containment lip 54 with containment shelf 52. The part of containment shelf 52 that extends inwardly to the trough need not be the portion of shelf 52 over which a portion of containment lip 54 extends to mate with containment shelf 52. When a portion of containment lip 54 extends over a portion of containment shelf 52, the elements are mated.

Figure 8:
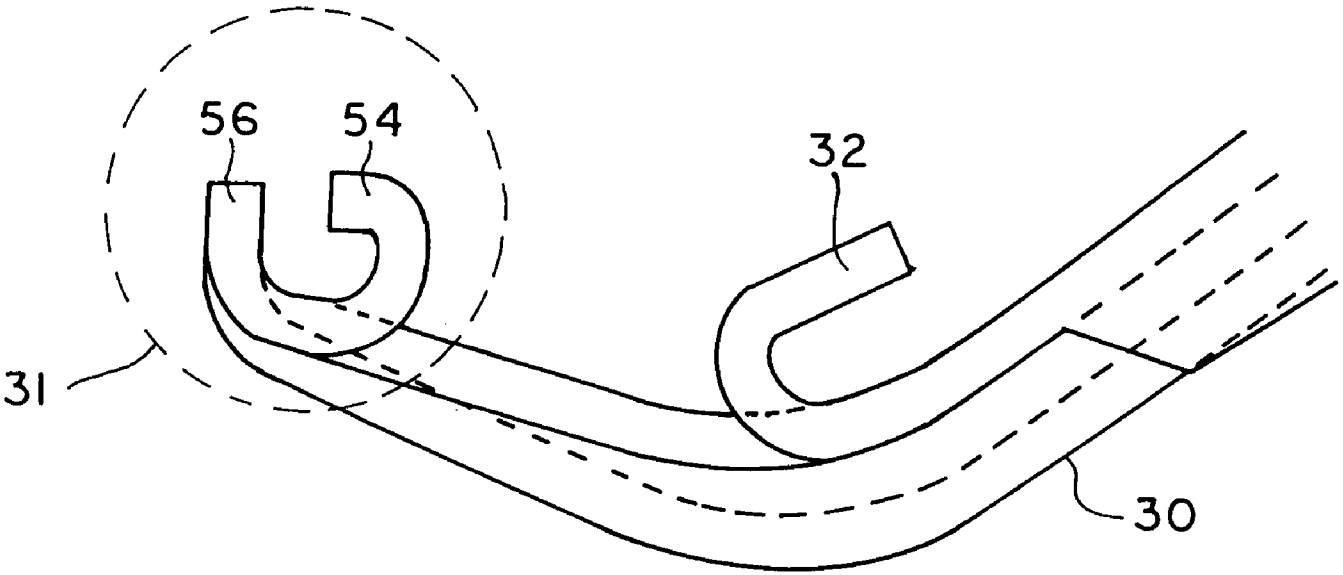
FIG. 8 is an enlarged depiction of a receptive cavity structure of a hanger configured in accordance with a preferred embodiment.

FIG. 8 is an enlarged depiction of receptive cavity structure 31 of hanger 30 in a preferred embodiment. Receptive cavity structure 31 as shown in FIG. 8, includes fulcrum ridge 56 over which, rise 53 of front containment wall border area 16 tents.

Figure 9:
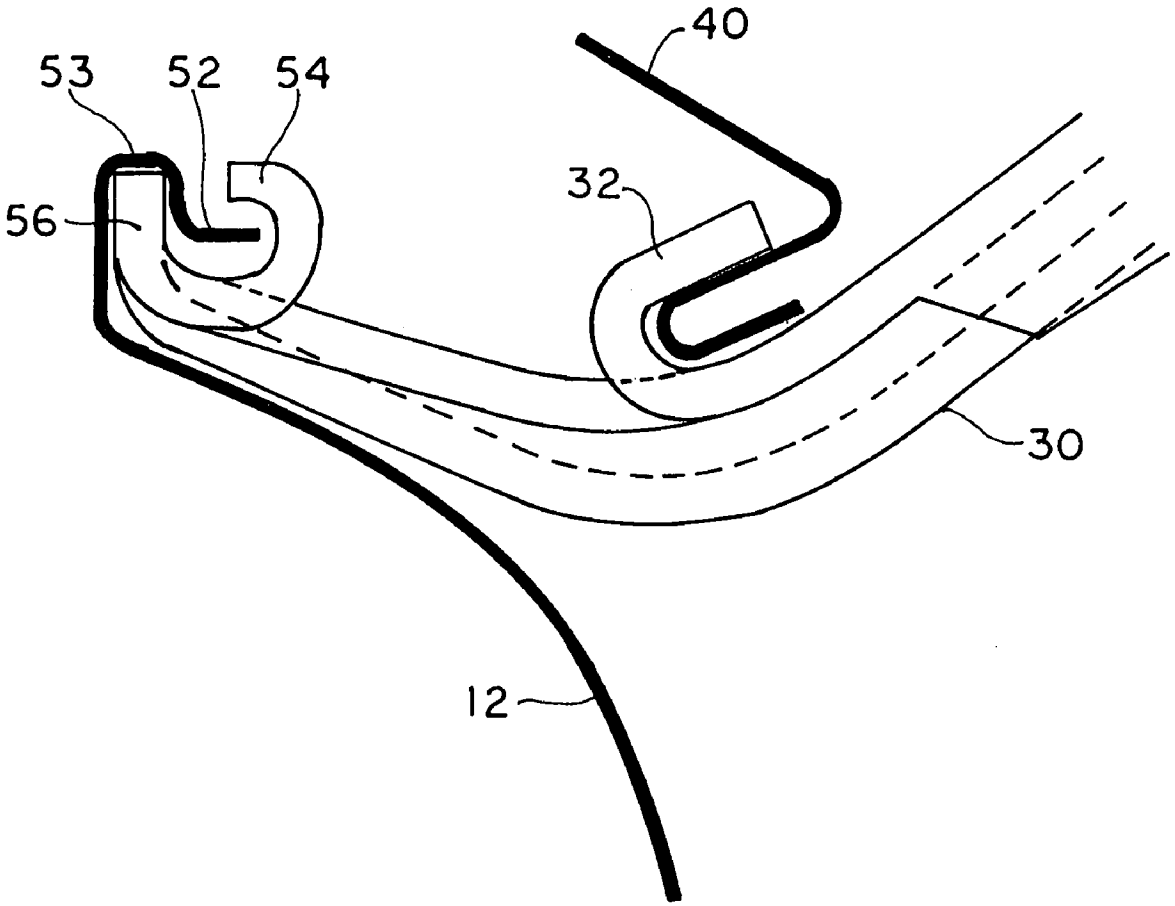
FIG. 9 depicts the border area of a trough and a receptive cavity structure of a hanger configured in accordance with a preferred embodiment of the present invention.

FIG. 9 depicts a preferred disposition of containment lip 54 mated with containment shelf 52 to provide functional water bearing capacity for trough 10 while still allowing sufficient standard material coil to provide a back wall 18 of sufficient height to provide necessary inclination for deflector 40. In this preferred depiction, containment lip 54 is mated with containment shelf 52.

Figure 11:
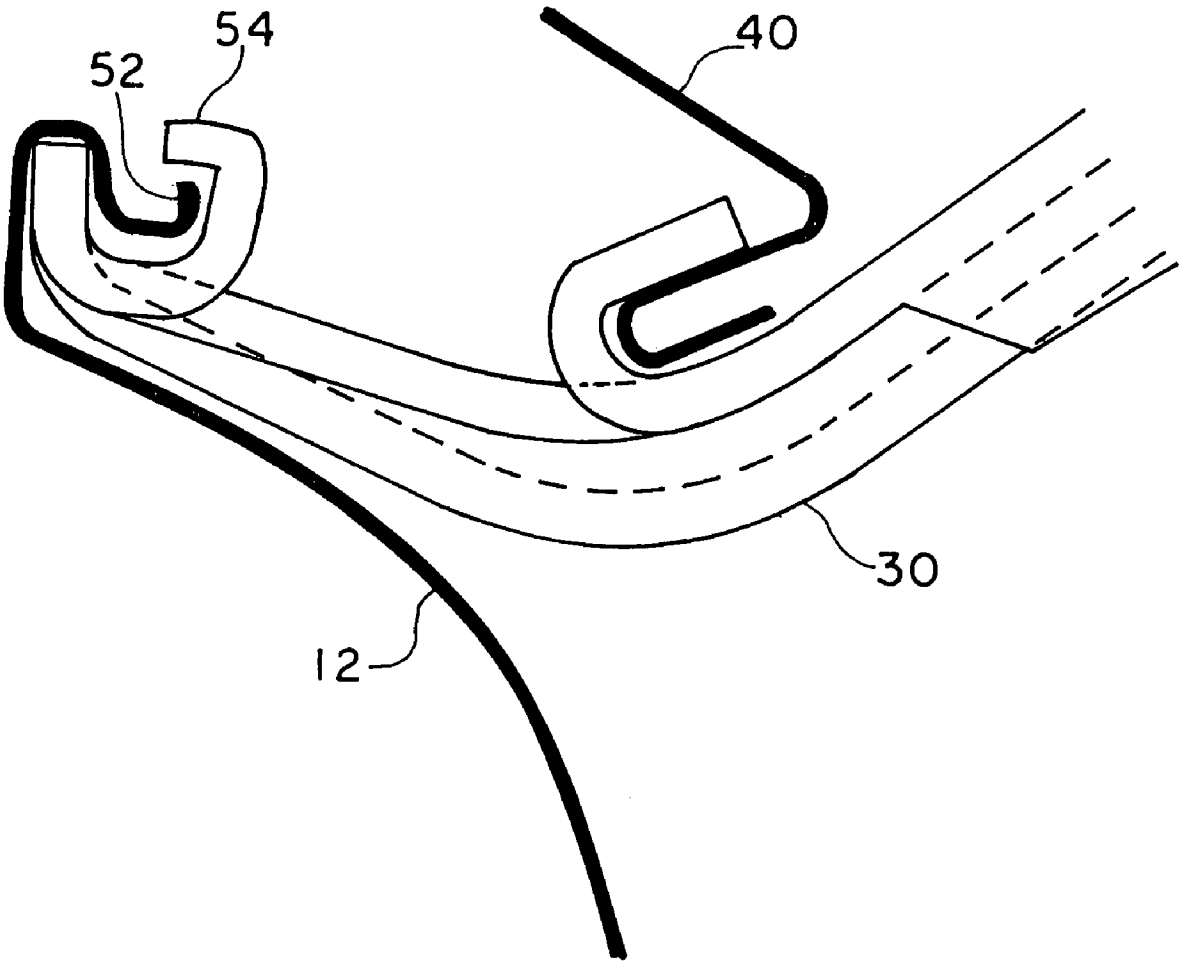
FIG. 11 depicts the border area of a trough and a receptive cavity structure of a hanger configured in accordance with an alternative embodiment of the present invention.
Figure 12:
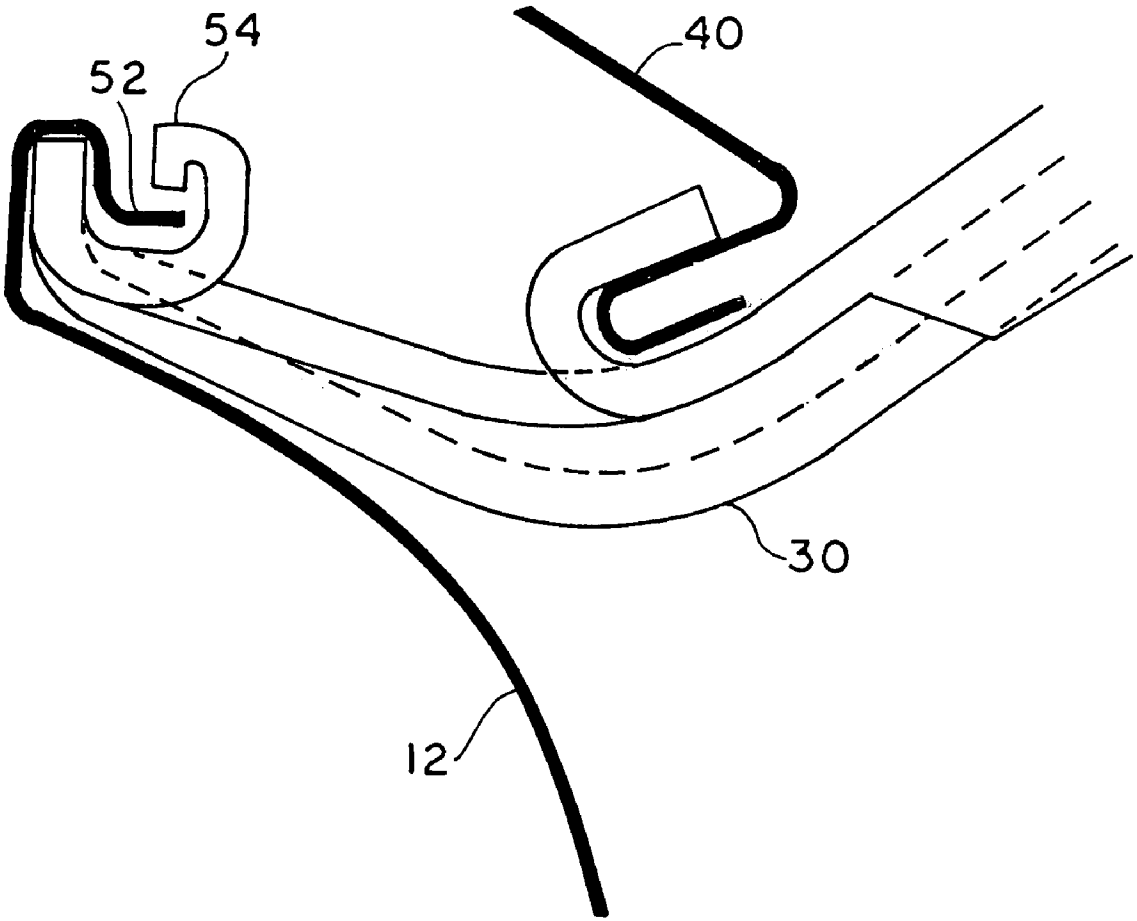
FIG. 12 depicts the border area of a trough and a receptive cavity structure of a hanger configured in accordance with another alternative embodiment of the present invention.

FIGS. 10, 11, and 12 depict alternative arrangements for the mating between containment lip 54 and containment shelf 52 and they are included only as example embodiments and not as limitations for the scope of the present invention. FIG. 10 depicts an alternative embodiment of the invention showing containment shelf 52 as angled upward and containment lip 54 as angled downward as shelf 52 and lip 54 are mated. In other alternative and exemplar but not to be construed as limiting embodiments, containment lip 54 may be horizontal while containment shelf 52 is angled or containment lip 54 may be angled while containment shelf 52 exhibits a horizontal character or each may be independently angled or horizontal.

FIG. 11 shows another alternative embodiment of the present invention in which containment lip 54 extends over a vertical extension portion of containment shelf 52. This is another example of the mating of containment lip 54 and containment shelf 52.

FIG. 12 shows yet another alternative embodiment of the present invention in which containment lip 54 has an extension that deflects downward over a portion of containment shelf 52. Containment lip 54 and containment shelf 52 are mated in the depiction of FIG. 12.

Figure 13:
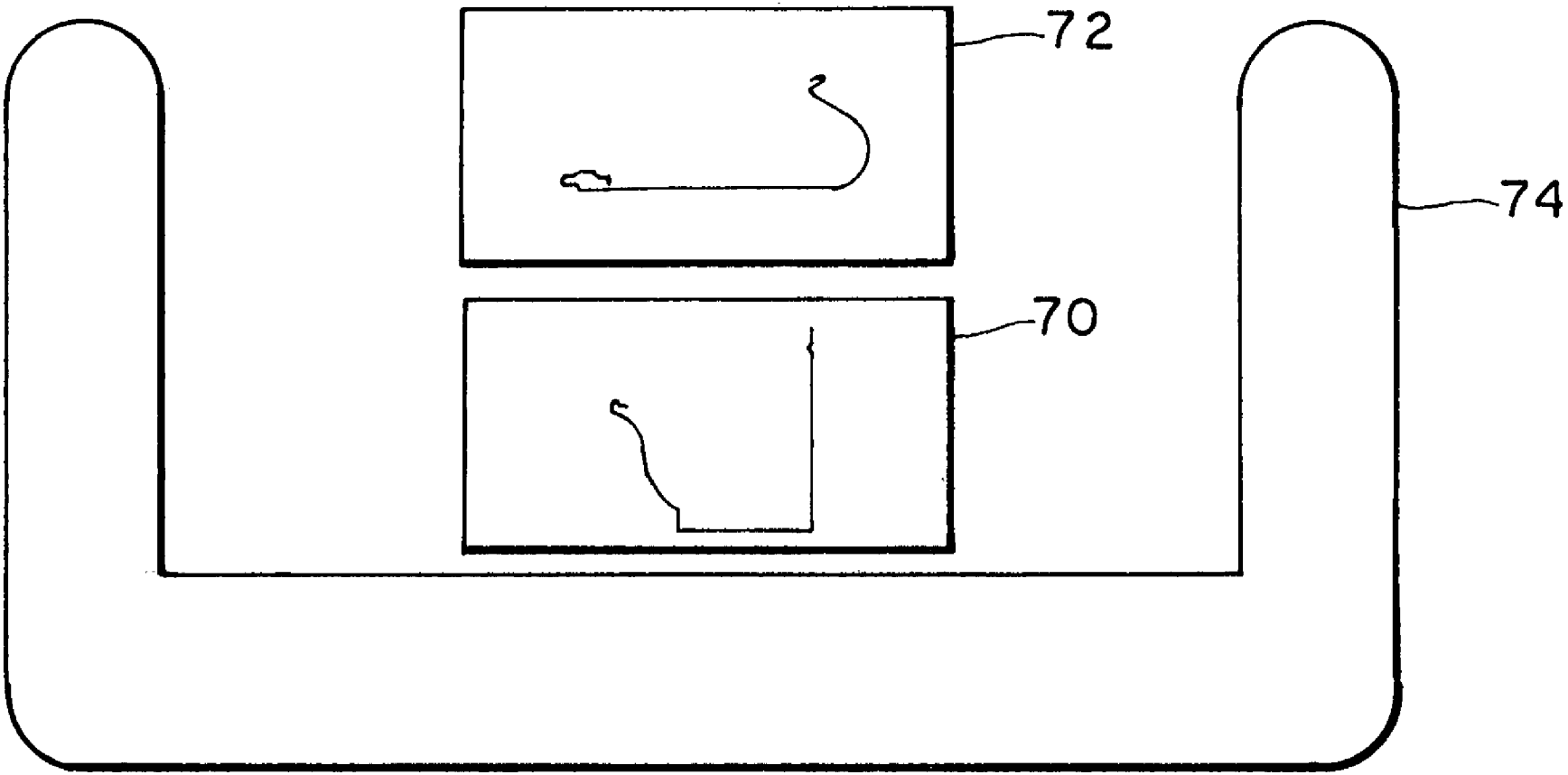
FIG. 13 is an end-on depiction of a forming machine disposed above a second forming machine as employed in a preferred embodiment of the present invention.
Figure 14:
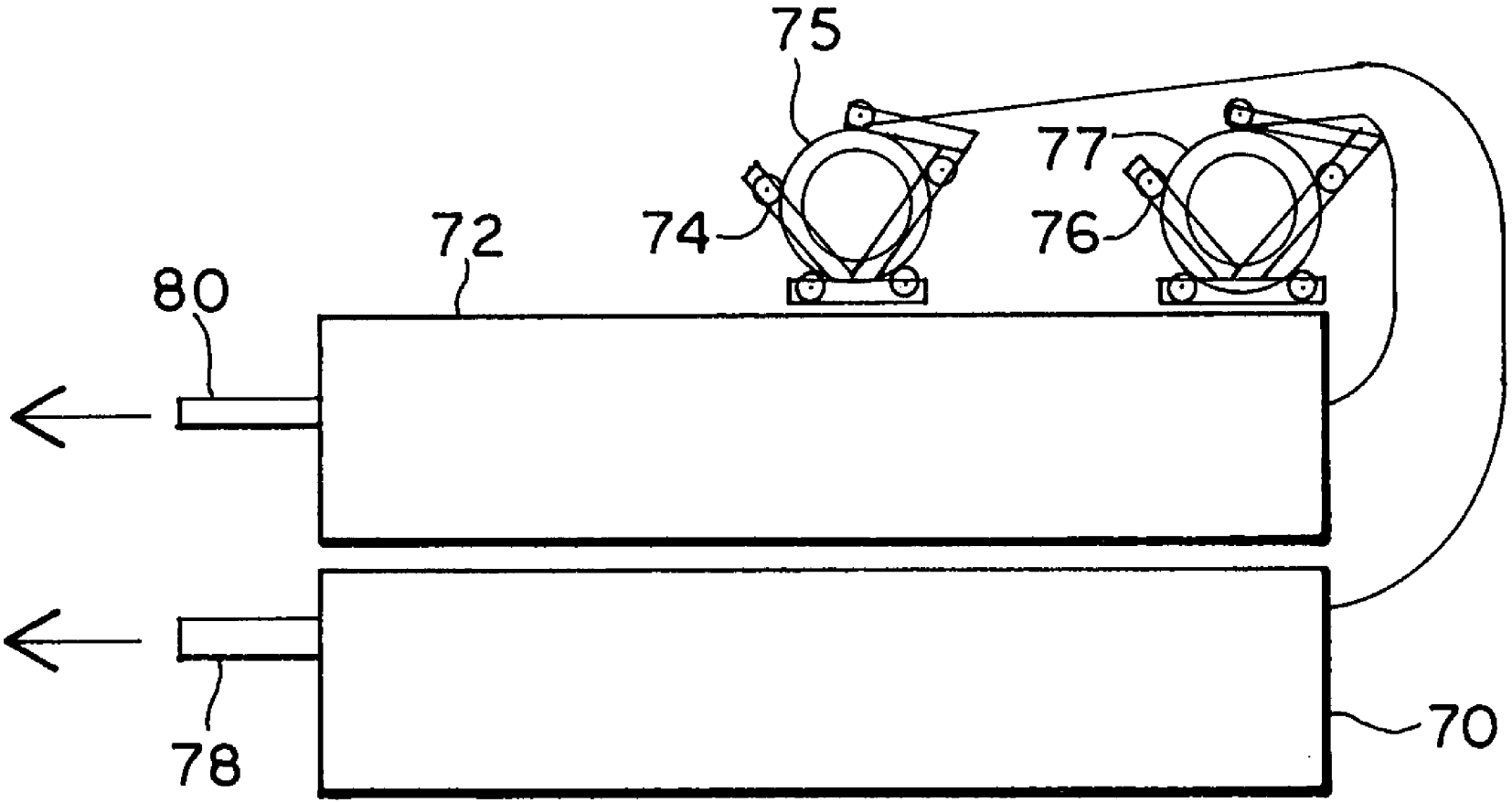
FIG. 14 is a plan view of two offset forming machines as employed in a preferred embodiment of the present invention.

The present invention provides numerous advantages during installation of the system. A preferred method for installation includes formation of deflector 40 with a machine placed above a forming machine dedicated to formation of trough 10. FIG. 13 depicts forming machine 72 disposed above forming machine 70 in the bed 74 of a truck. The machines need not be placed on the truck bed that is merely shown as an exemplar setting. Preferably, a track is employed that allows forward and backward movement of upper machine 72 relative to the bottom machine 70 for maintenance of the lower machine 70 as will be recognized by those of skill in the art. Machine 70 is configured to form lengths of trough 10 configured in accordance with the present invention, while machine 72 is configured to form lengths of deflector 40 configured in accordance with the present invention.

In a preferred method in accordance with the present invention, material cradles 74 and 76 of the respective machines 70 and 72 are loaded with coil. Trough machine 70 consumes coil material 75 of 11⅞ inches in width in an application configured to produce troughs 5 inches in width. Other widths of coil may also be used. Cradle 76 of deflector machine 72 is loaded with coil material 77 of between 7⅝ inches and 8 inches to produce deflectors. Other widths may be used for larger or smaller configurations. Emergent from machine 70 are lengths 78 of trough 10. Emergent from machine 72 are lengths 80 of deflector 40.

Figure 15:
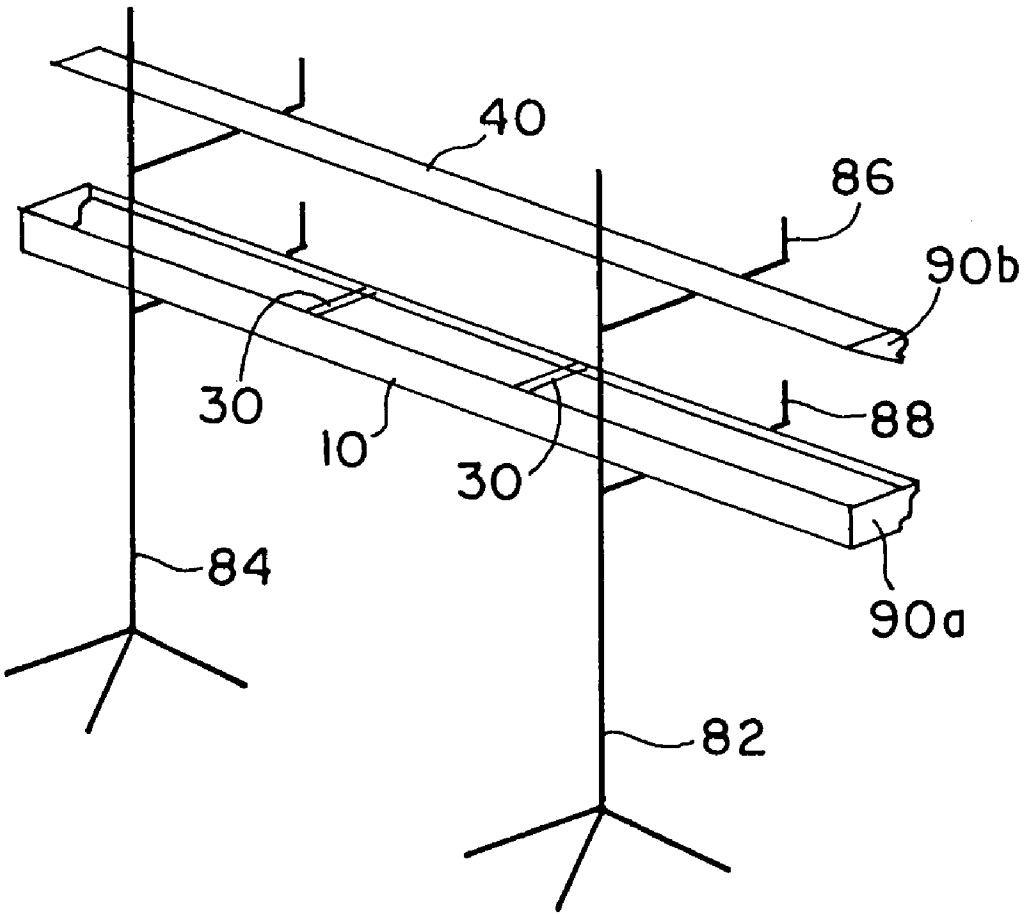
FIG. 15 depicts two-armed run-out stands as employed in a preferred embodiment of the present invention.

As shown in FIG. 15, two-armed run-out stands 82 and 84 having upper arms 86 and lower arms 88 provide work placement for lengths of deflector 40 and trough 10. End caps 90*a* are placed in appropriate locations. In a preferred embodiment, end caps are two-piece, with piece 90*a* fitted to troughs 10 and piece 90*b* fitted to deflector 40.

A preferred method for installation of the present system proceeds as follows. As length 78 of trough 10 is run from machine 70, end caps 90*a* are installed where appropriate, outlet sites are punched and outlets installed for joinder with downspouts, miters are cut and cavity structure 31 of hanger 30 is brought into place to mate containment lip 54 of hanger 30 with containment shelf 52 of trough 10. Hangers 30 are punched through the back wall 18 of trough 10 and prongs 36 are crimped. These steps can be performed either at the machine or with the assistance of the run-out stands. Hanger fitted trough 10 is rested on run-out stands.

Corresponding length 80 of deflector 40 is run from machine 72 and is installed with end caps 90*b* and miters are cut appropriate. Length 80 of deflector 40 is placed on length 78 of trough 10 as deflector attachment cavities 34 and 32 are used to retain deflector 40. In alternative methods, cavity 34 is used to retain deflector 40 for conveyance to the installation location on the structure but, where some distance is involved, use of both cavities 32 and 34 keeps deflector 40 more securely retained. In either case, the entire assembly may then be transported to a location on a lower level such as ground, for example, corresponding to the eventual installation location on the structure. The process is repeated until all assemblies of trough, hangers and deflector have been processed.

Two installers are then employed on ladders or other riser to position each length of assembled trough, hangers, and deflector into place against the structure where the assembly is fastened into place in at least two locations. This is simplified by the feature of the present invention that allows compression fitting of the deflector into the appropriate cavities of hanger 30. The process of two-installer positioning continues around the structure. One installer takes up a position on the roof of the structure or ladder and completes the affixation of the fasteners 50. This can be readily performed by one person due to the compression fitting of deflector 40 that allows opening the assembly to reach fastener 50. Once fasteners for a length of the assembly have been affixed, deflector 40 is compressed to fit flex fold 42 and attachment fold 46 of deflector 40 to cavities 34 and 32 respectively of deflector 40. As the roof or ladder positioned installer proceeds with this procedure of fastener affixation, the second installer forms downspouts and attaches them to the structure.

Although the present invention has been described in detail, it will be apparent to those skilled in the art that the invention may be embodied in a variety of specific forms and that various changes, substitutions and alterations can be made without departing from the spirit and scope of the invention. The described embodiments are only illustrative and not restrictive and the scope of the invention is, therefore, indicated by the following claims.

I claim:

1. A method for assembling a rain diversion system, the method comprising the steps of:

forming with a first machine, a trough having a front containment wall and a back wall, the back wall having a placement dimple;

providing a hanger emergent from the rear of which hanger is a penetrative projection and disposing the hanger in relation to the back wall to cause the penetrative projection to cooperate with the placement dimple to preliminarily position the hanger.

2. A method for producing & rain diversion system, the method comprising the steps of:

forming with a first machine, a trough; and forming with a second machine, a deflector and disposing the second machine above the first machine in a relationship that allows forward and backward movement of the second machine relative to the first machine.

3. A method of producing hooded gutter systems, the method comprising the steps of:

production of trough with a first machine, the first machine disposed to consume, in its production of trough, a first coil material;

production of deflector with a second machine; the second machine being placed above the first machine and the second machine disposed to consume, in its production of deflector, a second coil material;

providing a first coil holding structure to be loaded with the first coil material;

providing a second coil holding structure to be loaded with the second coil material, the first and second coil holding structures being placed above the second machine and relatively positioned so that the first coil material passes over at least a portion of the second coil holding structure before the first coil material passes into the first machine for consumption by the first machine.

4. The method of claim 3 in which the first and second coil holding structures are cradles.

5. A method of producing a rain diversion system, the method comprising the steps of:

producing lengths of trough with a first machine;

producing lengths of deflector with a second machine;

disposing the second machine above the first machine;

placing a length of trough and a length of deflector on a two-headed run-out stand.

6. A method of producing a rain diversion system, the method comprising the steps of:

producing a length of trough with a first machine;

producing a length of deflector with a second machine, the length of deflector to be used with the length of trough as components of the rain diversion system;

placing upon a two-headed run-out stand, the length of deflector above the length of trough prior to using the length of deflector and the length of trough in the rain diversion system.

7. A method of forming a rain diversion system, the method comprising the steps of:

forming with machinery supported by the bed of a truck a trough and a deflector, the deflector being formed above the trough.

8. A method of forming a rain diversion system, the method comprising the steps of:

forming a trough and a deflector with machinery located on a vehicle, the forming of the deflector being performed above the forming of the trough.

9. A method of forming a rain diversion system, the method comprising the steps of:

forming a trough;

forming a deflector so that the forming of the deflector occurs above the forming of the trough.

10. A method of forming a rain diversion system, the method comprising the steps of:

forming a trough and a deflector in a truck, the forming of the deflector occurring above the forming of the trough.

11. A method of forming a rain diversion system, the method comprising the steps of:

forming a trough and a deflector with machinery located on a vehicle, the forming of the deflector being performed above the trough.

12. A method of forming a rain diversion system, the method comprising the steps of:

forming a trough and a deflector, one above the other, with machinery located on a vehicle.

13. A method of forming a rain diversion system, the method comprising the steps of:

forming a deflector so that the forming of the deflector occurs above the trough.

* * * * *